US009451348B2

(12) United States Patent
Zhao et al.

(10) Patent No.: US 9,451,348 B2
(45) Date of Patent: Sep. 20, 2016

(54) ELECTRONIC DEVICE HOUSING

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Jian-Zhou Zhao, Shenzhen (CN); Yan Liang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/695,884

(22) Filed: Apr. 24, 2015

(65) Prior Publication Data

US 2016/0212518 A1 Jul. 21, 2016

(30) Foreign Application Priority Data

Jan. 19, 2015 (CN) ..... 2015 1 0024995

(51) Int. Cl.

| | |
|---|---|
| ***H04R 25/00*** | (2006.01) |
| ***H04R 1/08*** | (2006.01) |
| ***H04R 1/20*** | (2006.01) |
| ***H04R 1/22*** | (2006.01) |

(52) U.S. Cl.

CPC ..... *H04R 1/086* (2013.01); *H04R 1/08* (2013.01); *H04R 1/20* (2013.01); *H04R 1/222* (2013.01); *H04R 25/65* (2013.01); *H04R 2410/07* (2013.01); *H04R 2499/11* (2013.01)

(58) Field of Classification Search

CPC ..... H04R 1/08; H04R 1/086; H04R 25/48; H04R 25/604; H04R 25/65; H04R 25/654; H04R 2410/07; H04R 1/12; H04R 1/20; H04R 1/222; H04R 2499/11

USPC ..... 381/313, 322, 324, 325, 328, 330, 355, 381/359, 365, 386, 189; 379/439, 451, 452; 181/149; 455/575.1, 575.8

See application file for complete search history.

(56) References Cited

U.S. PATENT DOCUMENTS

| | | | | |
|---|---|---|---|---|
| 6,512,834 | B1 * | 1/2003 | Banter | H04R 1/086 381/189 |
| 6,932,187 | B2 * | 8/2005 | Banter | H04R 1/086 181/149 |
| 7,676,050 | B2 * | 3/2010 | Sauer | H04R 25/65 381/322 |
| 2007/0140516 | A1 * | 6/2007 | Fickweiler | H04R 25/405 381/313 |

* cited by examiner

*Primary Examiner* — Huyen D Le
(74) *Attorney, Agent, or Firm* — Zhigang Ma

(57) ABSTRACT

An electronic device housing includes an outer casing, a microphone, and a recess in the outer casing proximate to the microphone. A base of the recess has a first adhesive portion and an adjacent first non-adhesive portion, and a hole is defined in the first non-adhesive portion and the recess. The hole and the recess define an acoustic pathway for sound external to the outer casing to reach the microphone. The first adhesive portion and the first non-adhesive portion have different shapes.

14 Claims, 4 Drawing Sheets

ELECTRONIC DEVICE HOUSING

FIELD

The present disclosure relates to housings, and more particularly, to a housing for an electronic device.

BACKGROUND

Currently, electronic devices, such as mobile phones and tablet computers are often equipped with microphone holes. Users can transfer sound information through the microphone hole to receivers. The microphone hole is usually accommodated in an electronic device housing, and a dust-proof net is usually attached to the inside of the electronic device housing to cover the microphone hole. In attaching the dust-proof net, a part of the dust-proof net can be attached with double sided adhesive, and then the part of the dust-proof net with the double sided adhesive can be attached to the electronic housing, and the other part of the dust-proof net without the double sided adhesive can cover the microphone hole. As sizes of the microphone hole and the dust-proof net are small, the dust-proof net is difficult to accurately position and the double sided adhesive may cover the microphone hole.

BRIEF DESCRIPTION OF THE DRAWINGS

Implementations of the present technology will now be described, by way of example only, with reference to the attached figures.

DETAILED DESCRIPTION

Figure 1:
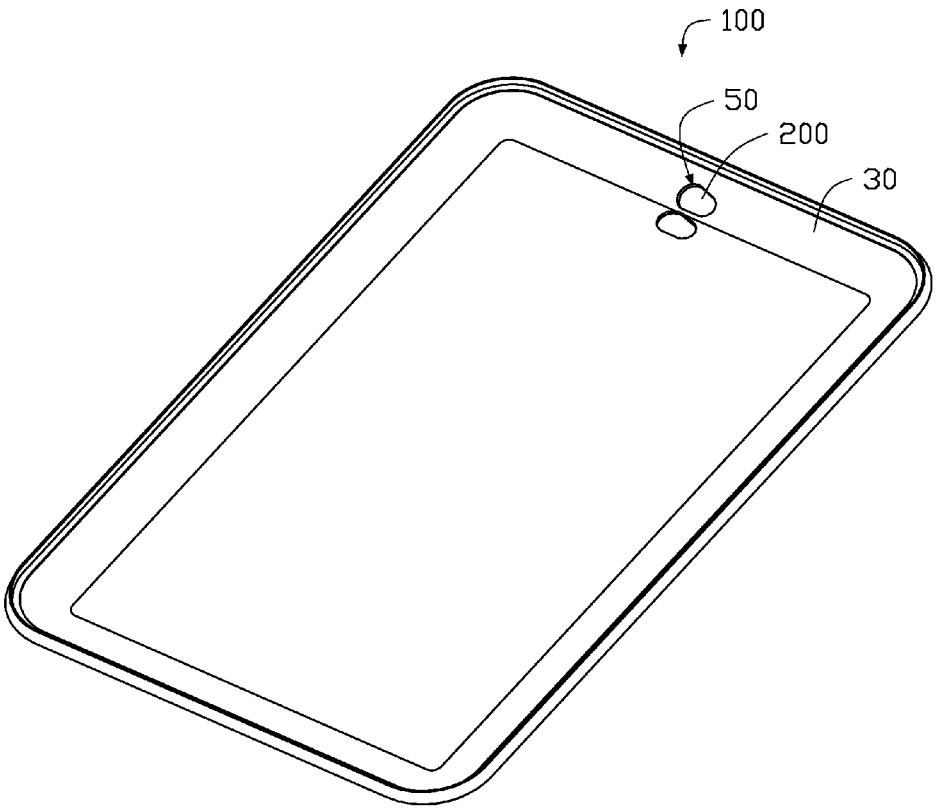
FIG. 1 is an isometric view of a first embodiment of an electronic device housing equipped with dust-proof nets.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

The present disclosure is described in relation to an electronic device housing for an electronic device. The electronic device can be a mobile phone, a tablet computer, or other electronic devices.

FIG. 1 illustrates that an electronic device housing 100 of a first embodiment includes an outer casing 30. The outer casing 30 can define a microphone hole 50. The microphone hole 50 can extend through the electronic device housing 100, thus users can transfer sound information through the microphone hole 50. The electronic device housing 100 can further include a dust-proof net 200 covered on the microphone hole 50. The dust-proof net 200 can be used to prevent dust from dropping into the electronic device through the microphone hole 50.

Figure 2:
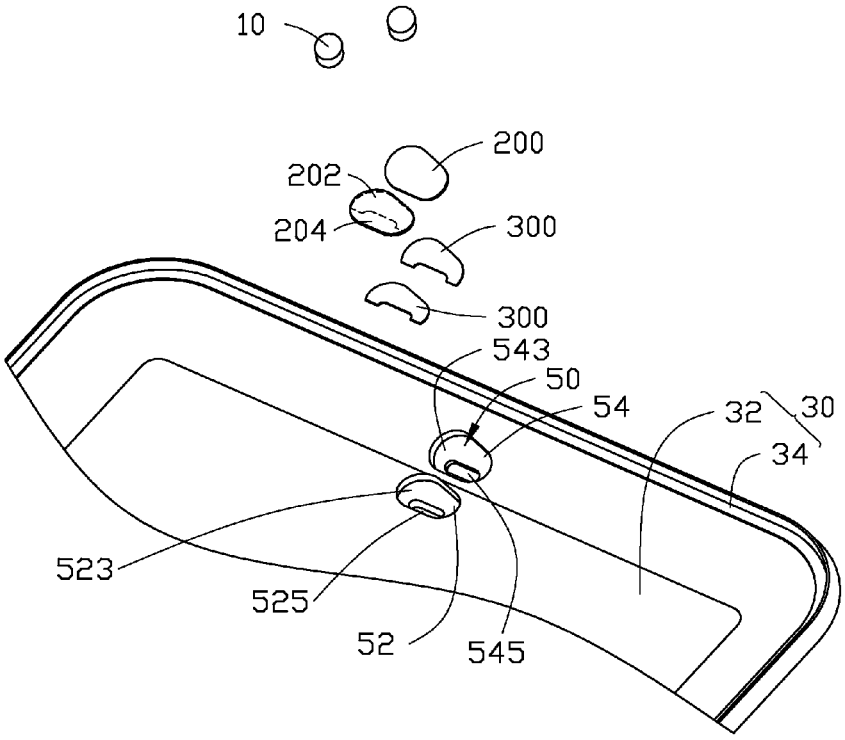
FIG. 2 is a partial, exploded view of the electronic device housing shown in FIG. 1.

Referring now to FIG. 2, the outer casing 30 can include a bottom wall 32 and a side wall 34. The side wall 34 can extend from periphery of the bottom wall 32 and can be bent or curved. The electronic device housing 100 can further include two microphones 10. The microphone hole 50 can include a first microphone hole 52 and a second microphone hole 54. The first microphone hole 52 can be defined at one end portion of the bottom wall 32, and the second microphone hole 54 can be defined in the side wall 34 and adjacent to the first microphone hole 52. The first microphone hole 52 can include a recess 523 and a hole 525 in the recess 523. The recess 523 can be proximate to the microphone 10 and used to mount the dust-proof net 200. The hole 525 can extend through the recess 523. The recess 523 and the hole 525 define an acoustic pathway for sound external to the outer casing 30 to reach the microphone 10. In other embodiments, the microphones 10 can have a shape substantially the same with the hole 525. The second microphone hole 54 can have a same structure with the first microphone hole 52, and can include a recess 543 and a hole 545.

The electronic device housing 100 can include two dust-proof nets 200 corresponding to the first recess 52 and the second recess 54.

Figure 3:
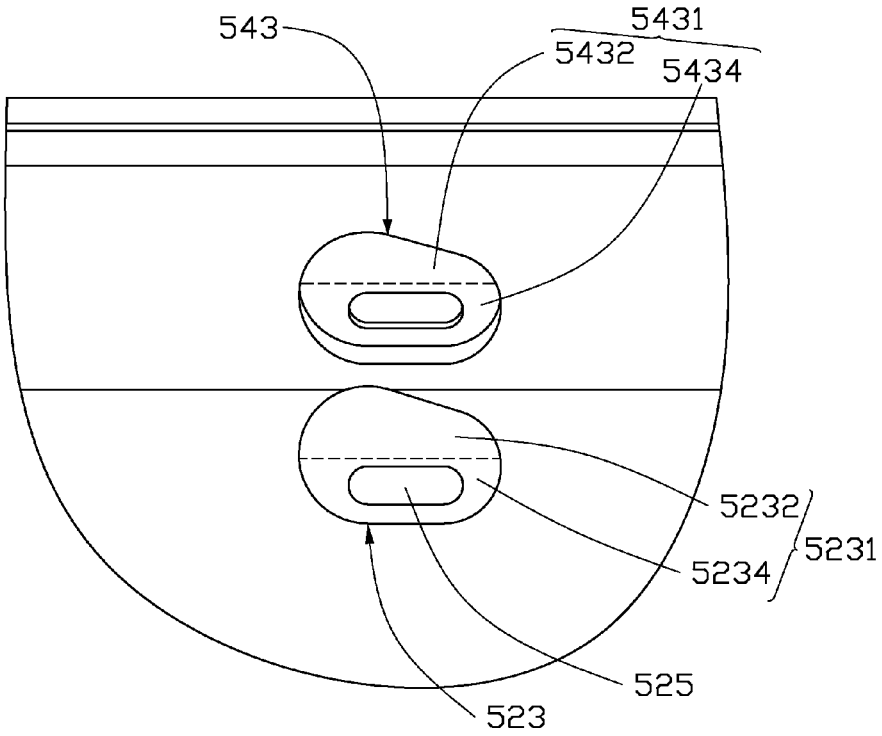
FIG. 3 is a partial view of the electronic device housing shown in FIG. 2 from another angle.

FIG. 3 illustrates that a base 5231 of the recess 523 can include a first adhesive portion 5232 and a first non-adhesive portion 5234 in communication with the first adhesive portion 5323. A base 5431 of the recess 543 can include a first adhesive portion 5432 and a first non-adhesive portion 5434 in communication with the first adhesive portion 5432. A double sided adhesive 300 can be attached to the first adhesive portion 5232, thereby the dust-proof net 200 can be fixed at the base 5231 of the recess 523. Another double sided adhesive 300 can be attached to the first adhesive portion 5432. The hole 525 can be defined through a bottom portion of the first non-adhesive portion 5234. The adhesive portion 5232 and the non-adhesive portion 5234 can have different shapes.

In at least one embodiment, both of a shape of the first adhesive portion 5232 and a shape of the first non-adhesive portion 5234 can be non-symmetrical. When attaching the dust-proof net 200 to the recess 523, one surface of the dust-proof net 200 can be attached with the double sided adhesive 300. The dust-proof net 200 can be deposited into the recess 523 and 543 in only one direction, preventing the surface of the dust-proof net 200 with the double sided adhesive 300 from depositing away from the bottom of the recess 523. In other embodiments, only one of the first adhesive portion 5232 and the first non-adhesive portion 5234 can be non-symmetrical.

The recess 543 of the second microphone hole 54 can be the same with the recess 523 of the first microphone hole 52.

In at least one embodiment, the holes 525 and 545 can be long holes. The holes 525 and 545 can be defined through the bottom of the first non-adhesive portions 5234 and 5434, and arranged at the same side of the first adhesive portions 5232 and 5432.

FIG. 2 further illustrates that the dust-proof net 200 can be attached to the recess 523. A shape of the dust-proof net 200 can be the same with a shape of the recess 523. The dust-proof net 200 can include a second adhesive portion 202 and a second non-adhesive portion 204 connected to the second adhesive portion 202. A surface of the second adhesive portion 202 toward the recess 523 can be attached with the double sided adhesive 300, and the second adhesive portion 202 can be attached to the bottom of the first adhesive portion 5232 through the double sided adhesive 300. The second non-adhesive portion 204 can cover the first non-adhesive portion 5234 and the hole 525.

The first adhesive portion 5232 and the first non-adhesive portion 5234 have different shapes, and the dust-proof net 200 and the mounting holes 523 and 543 have the same shape. Therefore, the second adhesive portion 202 which is attached with the double sided adhesive 300 can be only deposited to the first adhesive portion 5232; it cannot be deposited to the first non-adhesive portion 5234. The electronic device housing 100 can prevent the double sided adhesive 300 from enclosing the hole 525. As the shape of the first adhesive portion 5232 or the shape of the first non-adhesive portion 5234 is non-symmetrical, the dust-proof net 200 can be deposited into the recess 523 and 543 in only one direction, preventing the surface of the dust-proof net 200 with the double sided adhesive 300 from depositing away from the bottom of the recess 523 when attaching the dust-proof net 200. Furthermore, the two holes 525 and 545 are defined at the same side of the adhesive portion 5232 and 5432, thus the time of mounting the dust-proof nets 200 can be saved.

Figure 4:
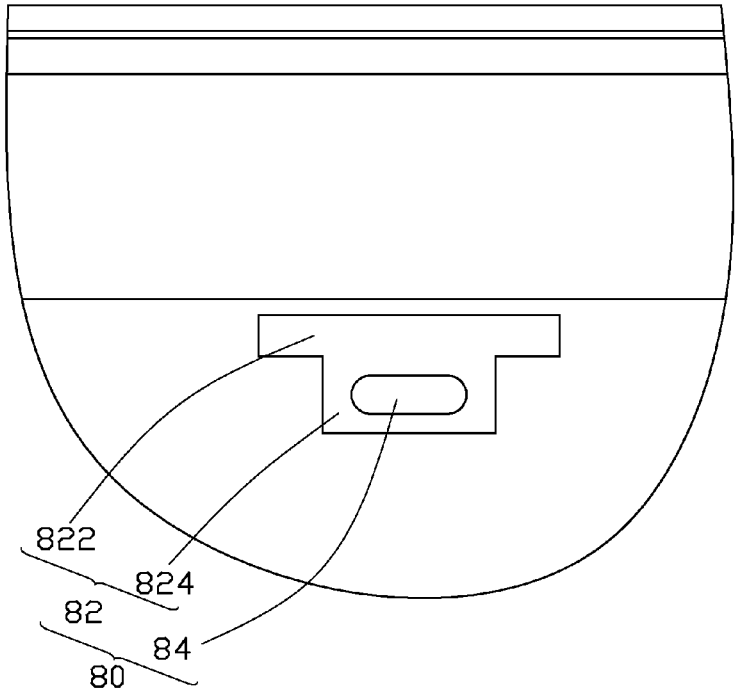
FIG. 4 is a partial, top view of a second embodiment of an electronic device housing.

FIG. 4 illustrates a microphone hole 80 of a second embodiment of this disclosure. The microphone hole 80 can include a recess 82 and a hole 84. The recess 82 can include a first adhesive portion 822 and a first non-adhesive portion 824, and the hole 84 can be defined through the non-adhesive portion 824. The first adhesive portion 822 and the first non-adhesive portion 824 can be rectangular, and a shape of the first adhesive portion 822 can be different with a shape of the first non-adhesive portion 824, thus the adhesive portion 822 and the first non-adhesive portion 824 can be asymmetric to each other.

In other embodiments, the shapes of the first adhesive portion 5232 and first non-adhesive portion 5234 can be other shapes, as long as the first adhesive portion 5232 and the first non-adhesive portion 5234 have different shapes.

In other embodiments, the microphone hole 50 can be positioned at other portion of the electronic device housing 100. For example, the microphone hole 50 can be positioned at two sides of the electronic device housing 100.

In other embodiments, the number of the microphone hole 50 can be one or more.

In other embodiments, both of the first microphone hole 52 and the second microphone hole 54 can be defined at the bottom wall 32 or the side wall 34.

The embodiments shown and described above are only examples. Many details are often found in the art such as the other features of an electronic device housing. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including, the full extent established by the broad general meaning of the terms used in the claims. It will therefore be appreciated that the embodiments described above may be modified within the scope of the claims.

What is claimed is:

1. An electronic device housing comprising:
an outer casing;
a dust-proof net;
a microphone;
a recess in the outer casing proximate to the microphone;
a base of the recess having a first adhesive portion and an adjacent first non-adhesive portion; and
a hole in the first non-adhesive portion and the recess, the hole and the recess defining an acoustic pathway for sound external to the outer casing to reach the microphone;
wherein the first adhesive portion and the first non-adhesive portion have different shapes; and
wherein the dust-proof net is mounted on the recess and has a same shape with the recess, and the dust-proof net comprises a second adhesive portion and a second non-adhesive portion connected to the second adhesive portion.

2. The electronic device housing of claim 1, wherein a shape of the first adhesive portion is non-symmetrical.

3. The electronic device housing of claim 1, wherein a shape of the first non-adhesive portion is non-symmetrical.

4. The electronic device housing of claim 1, wherein the electronic device housing comprises a microphone hole, and the microphone hole comprises a first microphone hole and a second microphone hole opposite to the first microphone hole; each of the first microphone hole and the second microphone hole comprises the recess and the hole.

5. The electronic device housing of claim 4, wherein the holes of the first microphone hole and the second microphone hole are defined at the same side of corresponding first adhesive portions.

6. The electronic device housing of claim 4,
wherein the outer casing further comprises a bottom wall and a side wall, and the side wall is bent and extends from periphery of the bottom wall; and
wherein the first microphone hole is defined at one end portion of the bottom wall, and the second microphone hole is defined in the side wall and adjacent to the first microphone hole.

7. The electronic device housing of claim 1, wherein the electronic device housing further comprises a double sided adhesive, the second adhesive portion is attached to the first adhesive portion through the double sided adhesive, and second non-adhesive portion overlaps with the first non-adhesive portion and the hole.

8. An electronic device housing comprising:
an outer casing;
a microphone;
a recess in the outer casing proximate to the microphone;
a base of the recess having a first adhesive portion and an adjacent first non-adhesive portion; and
a hole in the first non-adhesive portion and the recess, the hole and the recess defining an acoustic pathway for sound external to the outer casing to reach the microphone;

wherein the first adhesive portion and the first non-adhesive portion have different shapes;

wherein the electronic device housing defines a microphone hole, the microphone hole comprises a first microphone hole and a second microphone hole opposite to the first microphone hole, and each of the first microphone hole and the second microphone hole comprises the recess and the hole;

wherein the outer casing further comprises a bottom wall and a side wall, and the side wall is bent and extends from periphery of the bottom wall; and wherein the first microphone hole is defined at one end portion of the bottom wall, and the second microphone hole is defined in the side wall and adjacent to the first microphone hole.

9. The electronic device housing of claim 8, wherein a shape of the first adhesive portion is non-symmetrical.

10. The electronic device housing of claim 8, wherein a shape of the first non-adhesive portion is non-symmetrical.

11. The electronic device housing of claim 8, wherein the holes of the first microphone hole and the second microphone hole are defined at the same side of corresponding first adhesive portions.

12. The electronic device housing of claim 8, wherein the electronic device housing further comprises a dust-proof net, and the dust-proof net is mounted on the recess and has a same shape with the recess.

13. The electronic device housing of claim 12, wherein the dust-proof net comprises a second adhesive portion and a second non-adhesive portion connected to the second adhesive portion.

14. The electronic device housing of claim 13, wherein the electronic device housing further comprises a double sided adhesive, the second adhesive portion is attached to the first adhesive portion through the double sided adhesive, and second non-adhesive portion overlaps with the first non-adhesive portion and the hole.

* * * * *